US005554012A

United States Patent [19]

Itakura

[11] Patent Number: 5,554,012

[45] Date of Patent: Sep. 10, 1996

[54] AIR CONTROLLER FOR AIR PUMP

[75] Inventor: Tsuyoshi Itakura, Tokyo, Japan

[73] Assignee: Nihon Doubutsu Yakuhin Kabushikigaisya, Tokyo, Japan

[21] Appl. No.: 498,896

[22] Filed: Jul. 6, 1995

[51] Int. Cl.[6] ..... F04B 35/04

[52] U.S. Cl. ..... 417/410.1; 417/413.1; 310/15; 310/17

[58] Field of Search ..... 417/410.1, 412, 417/413.1; 310/15, 17, 19, 21, 25, 191, 209

[56] References Cited

U.S. PATENT DOCUMENTS

| | | | |
|---|---|---|---|
| 2,253,206 | 8/1941 | Farrow, Jr. et al. | 417/413.1 |
| 5,066,204 | 11/1991 | Point et al. | 417/413.1 |

FOREIGN PATENT DOCUMENTS

| | | | |
|---|---|---|---|
| 1703482 | 12/1971 | Germany | 417/413.1 |

*Primary Examiner*—Richard E. Gluck
*Assistant Examiner*—Roland G. McAndrews, Jr.
*Attorney, Agent, or Firm*—Emmanuel J. Lobato

[57] ABSTRACT

An air controller for an air pump capable of simply regulating the air delivery rate of the air pump. In an air pump including an electromagnetic driving mechanism 11, 13, 14, a magnet 17 carried on the tip of an arm 16, and a diaphragm 18 connected to the intermediate portion of the arm, the magnet being reciprocated by an electromagnetic action exerted between the electromagnetic driving mechanism and the magnet, the intake and discharge action being effected by the expansion and contraction of the diaphragm, the improvement lies in that the electromagnetic driving mechanism is mounted on a housing in such a manner that it is capable of advancing and retreating with respect to the magnet, whereby the advancement and retreat of the electromagnetic driving mechanism will cause the distance between the core 13 and magnet 17 and hence the reciprocating rate of the magnet to change, thus accomplishing the change of the air delivery rate.

7 Claims, 5 Drawing Sheets

AIR CONTROLLER FOR AIR PUMP

BACKGROUND OF THE INVENTION

1. Field of the Invention

The present invention relates generally to an air controller for an air pump and, more particularly, to an air controller for an air pump capable of regulating the air delivery rate of an air pump which supplies air for bubbling into a glass-sided tank for aquarium fish.

2. Description of the Related Arts

In general families or at places where a lot of people gather, it has been hitherto common to keep aquarium fish in a glass-sided tank to provide effective accessories in the interior of a room or to please the eyes of visitors. A typical tank for keeping such aquarium fish often has at its bottom a bubble generator into which air is fed from a small-sized air pump to generate air bubbles. A conventional type of the air pump is shown by way of example in FIG. 8. In the diagram, reference numeral 1 denotes a yoke firmly secured to a housing 2 for forming an electromagnetic circuit, 3 denotes a core mounted on the yoke 1, and 4 denotes an electromagnetic coil wound around the core 3 and connected to a power cord 5, the yoke 1, the core 3 and the electromagnetic coil 4 constituting an electromagnetic driving mechanism. Reference numeral 6 denotes an arm, and 7 denotes a magnet fitted to the tip of the arm 6 and adapted to be attracted or repelled by the core 3 in response to the electromagnetic on/off action so as to reciprocate between the yoke 1 and the electromagnetic coil 4. The arm 6 is mounted on the housing 2 displaceably in the direction of the reciprocating motion of the magnet 7. A diaphragm 8 is coupled to the arm 6 at substantially the middle part of the arm 6 in the longitudinal direction thereof. The diaphragm 8 is formed from a resilient material such as rubber capable of being contracted or expanded by an external force, namely the diaphragm 8 is actuated by the electromagnetic action of the electromagnetic driving mechanism, to take in air and then discharge the air through an air outlet 9. Thus, the air can be delivered to the tank by connecting a hose to the air outlet 9.

In the conventional air pump, however, the distance between the magnet 7 and the electromagnetic driving mechanism consisting of the yoke 1, the core 3 and the electromagnetic coil 4 is unitarily determined and ordinarily unchangeable, so that the air delivery rate of the air pump is constant. This can result in non-unique and monotonous bubbling state in the tank and may possibly bore the viewers. It may be also conceivable that in order to alter the distance between the magnet and the electromagnetic mechanism that in an arm mounting portion 10, the arm 6 is positioned closer to the sidewall 2*a* of the housing 2 or further away from the sidewall 2*a*. However, such measures would result in deformation of the diaphragm 8 due to excessive force applied thereto, and may possibly prevent smooth air intake and discharge from being carried out.

SUMMARY OF THE INVENTION

The present invention was conceived to overcome the above problems. It is therefore the object of the present invention to provide an air controller for an air pump capable of simply controlling the air delivery rate of the air pump.

In order to achieve the above object, according to the aspect of the present invention, there is provided an air controller for an air pump comprising an electromagnetic driving mechanism, a magnet carried on the tip of the arm, and a diaphragm connected to the intermediate portion of the arm, the magnet being reciprocated by the electromagnetic action exerted between the electromagnetic driving mechanism and the magnet, the intake and discharge action being carried out by the expansion and contraction of the diaphragm, characterized in that the electromagnetic driving mechanism is mounted on a housing in such a manner that it is movable in the longitudinal direction of the core.

In the above construction of the present invention, the diaphragm performs air intake and discharge action with the aid of the action of the electromagnetic driving mechanism. The air discharged from the diaphragm is introduced through a hose into a tank. Since the electromagnetic driving mechanism is movable in the longitudinal direction of the core of the electromagnetic driving mechanism, its movement will allow the distance between the core and the magnet to vary, thus making it possible to change the reciprocating rate of the magnet. This will enable the amount of intake and discharge of the diaphragm to be adjusted, realizing the change of the state of bubbling within the tank.

BRIEF DESCRIPTION OF THE DRAWINGS

These and other objects and features of the present invention will become more apparent upon consideration of the following description taken in connection with the accompanying drawings, in which.

DESCRIPTION OF THE PREFERRED EMBODIMENTS

Figure 1:
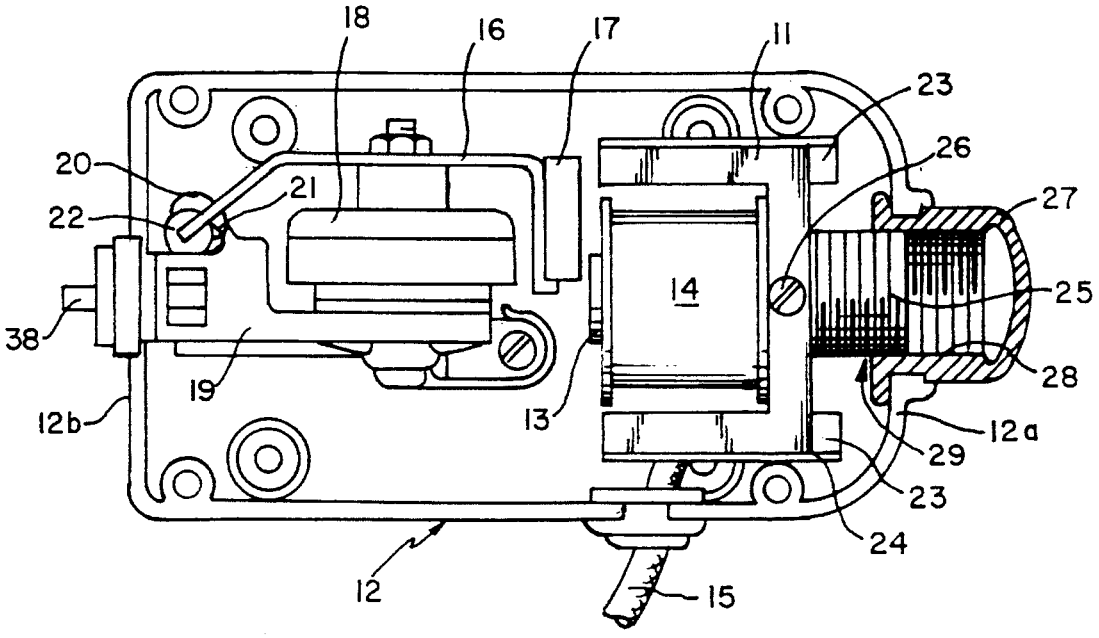
FIG. 1 is a top plan view of an air pump according to an embodiment of the present invention, with its interior structure exposed.

FIGS. 1 to 7 arc diagrams for explaining an embodiment of an air controller for an air pump according to the present invention. Referring first to FIG. 1, there is shown in top plan view an exposed internal structure of the air pump incorporating the air controller of this embodiment. In this diagram, reference numeral 11 denotes a yoke disposed in the vicinity of a sidewall 12*a* on one hand within a housing 12 in the shape of a cage and serving to form an electromagnetic circuit; reference numeral 13 denotes a core integrally mounted on the yoke 11 and serving to form the electromagnetic circuit in cooperation with the yoke 11; and reference numeral 14 denotes an electromagnetic coil wound around the core 13 and connected to a power cord 15, the yoke 11, the core 13 and the electromagnetic coil 14 constituting an electromagnetic driving mechanism for pumping action. Reference numeral 16 denotes an arm extending toward the electromagnetic coil 4 from a sidewall 12*b* confronting the sidewall 12*a* closer to the yoke 11 in the housing 12; and reference numeral 17 denotes a magnet fitted to the tip of the arm 16 and reciprocating between the yoke 11 and the electromagnetic coil 14 in response to the electromagnetic action exerted between the magnet 17 and the electromagnetic driving mechanism.

The arm 16 is comprised of a plate spring, whose base end is securely coupled to the frame member 19 so as to present a kind of cantilevered structure (Note that the displacement direction is in a vertical direction in FIG. 1). The frame member 19 is fixedly disposed substantially centrally of a space except the electromagnetic driving mechanism in the housing, the frame member 19 serving as a major member for firmly mounting various components. The frame member 19 is provided with a retaining section 20 for supporting the arm 16, the retaining section 20 being composed of a wall piece which extends from the outer wall of the frame member 19 and has a substantially circular shape in top plan view and whose tip terminates midway. The retaining section 20 defines a circular space 21 partially notched between the retaining section 20 and the body of the frame member 19. The arm 16 may be composed of a deflective plate spring directly secured to the retaining section 20 so as to present the cantilevered structure as described above. In this embodiment, however, a holding member 22 made of a resilient material such as rubber is embedded into a gap 21 as shown in FIG. 1, the base of the arm 16 being is coupled to the holding member 22. Thus, the displacement of the arm 16 is restricted by the resilient deformation of the holding member 22.

A diaphragm 18 is coupled to the intermediate portion of the arm 16 in the longitudinal direction. The diaphragm 18 is comprised of a resilient material such as hollow rubber capable of being contracted or expanded by an external force, leather, reinforced paper, or plastic. The diaphragm 18 has a valve mechanism to take in or discharge the air by the electromagnetic action of the electromagnetic driving mechanism. The frame member 19 is disposed adjacent to the diaphragm 18 on the discharge side so that the air discharged from the diaphragm 18 is led into the frame member 19.

Figure 2:
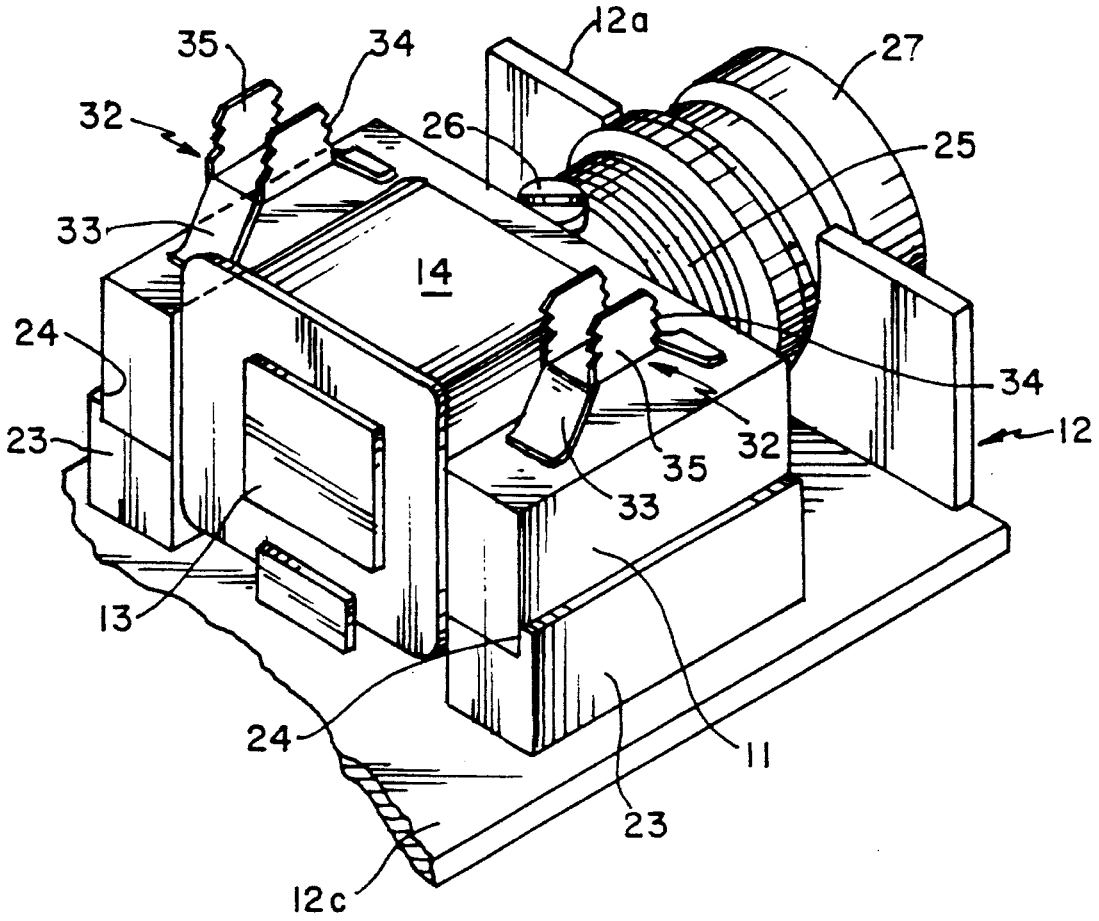
FIG. 2 is a fragmentary perspective view showing the constitution of an electromagnetic driving mechanism of the above embodiment.
Figure 3:
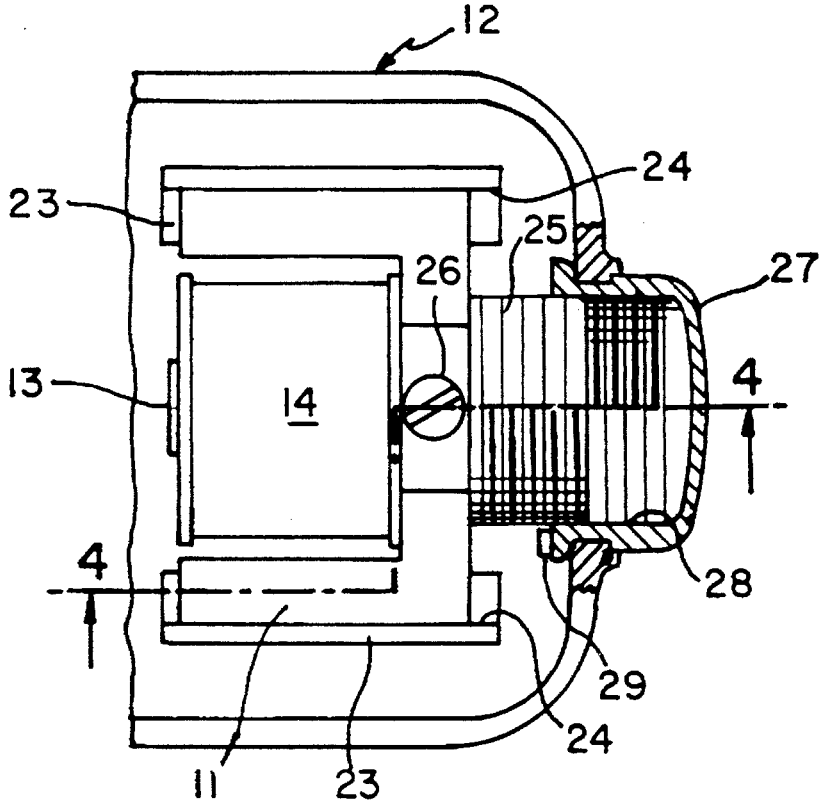
FIG. 3 is a fragmentary sectional view in plan showing the state of mounting of the electromagnetic driving mechanism onto the housing in the above embodiment.
Figure 4:
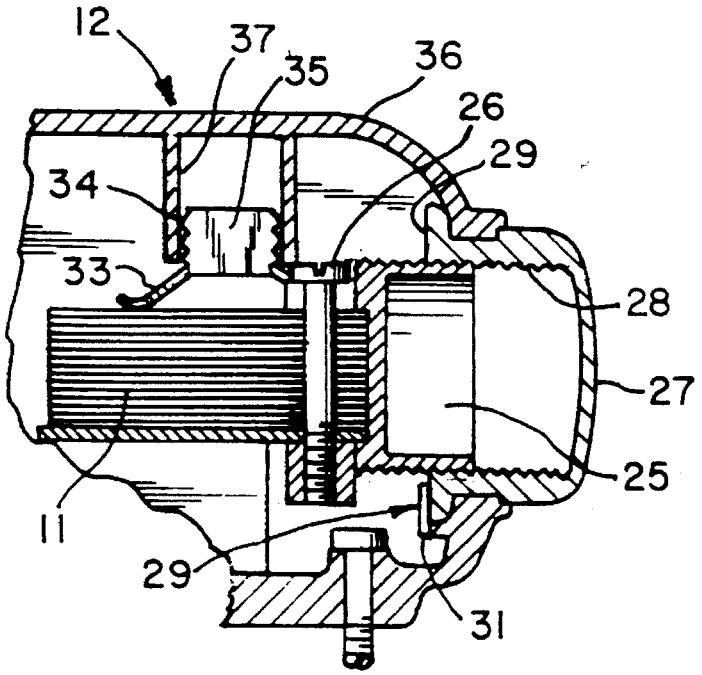
FIG. 4 is a fragmentary sectional view in side elevation taken along the line 4—4 of FIG. 3, showing the state of mounting of the electromagnetic driving mechanism onto the housing in the above embodiment.

Referring now to FIGS. 2 to 4, there is depicted a screw feed mechanism for advancing and retreating the yoke 11 and the electromagnetic driving mechanism including the yoke 11. Among them, FIG. 2 is a partial perspective view of the electromagnetic driving mechanism and the screw feed mechanism; FIG. 3 is a top plan view in section of the same; and FIG. 4 is a side elevational view in section of the same. As is apparent from these diagrams, the yoke 11 is provided on a pair of track members 23, which extend in parallel on a bottom plate 12*c* of the housing 12 and define a guide section 24 on their upper surfaces, in such a manner as to be displaceable in the forward and backward directions (right-to-left direction in FIG. 1) along the guide section 24. An externally-threaded member 25 is fixedly secured to the yoke 11 by a screw 26, with the male-threaded member 25 protruding toward the sidewall 12*a* of the housing 12. On the corresponding sidewall 12*a* of the housing 12 is rotatably mounted a cylindrical lug member 27, which has an appropriate diameter easy to grasp by the operator's hand, the cylinder having the inner wall provided with an internal thread 28 screwed to the externally threaded member 25. In connection with the engagement of the externally threaded member 25 with the lug member 27, the latter is fixed to the housing 12 without forward and backward movement, whereas the former is allowed to move forward and backward. Upon the advancement (movement directed toward the center of the housing), the yoke 11 comes closer to the magnet 17 to strengthen the electromagnetic action, whereas upon the retraction, the electromagnetic action is weakened. Accordingly, between the external thread provided on the externally threaded member 25 and the internal thread 28 there is established a left-hand thread relationship, whereupon a right-turn of the lug member 27 will strengthen the electromagnetic action whereas a left-turn will weaken the electromagnetic action.

Figure 5:
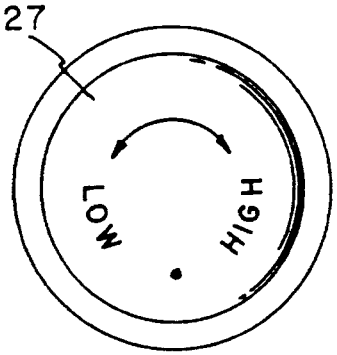
FIG. 5 is a front elevational view showing a configuration of the end surface of a lug member in the above embodiment.
Figure 6:
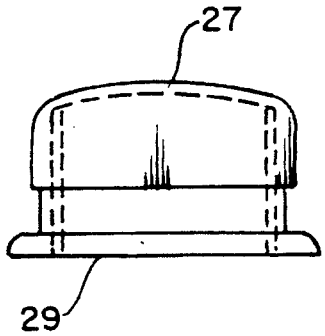
FIG. 6 is a top plan view showing the configuration of the end surface of the lug member in the above embodiment.
Figure 7:
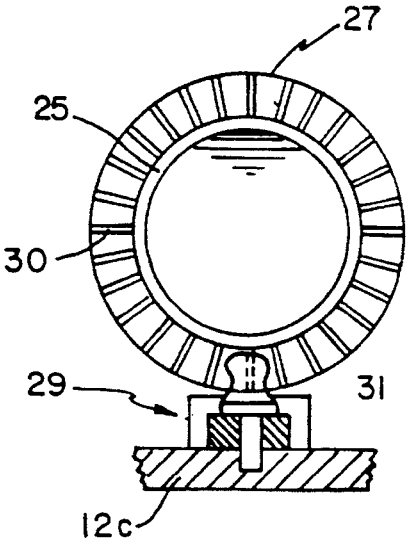
FIG. 7 is a fragmentary front elevational view showing a click section provided on the lug member in the above embodiment.
Figure 8:
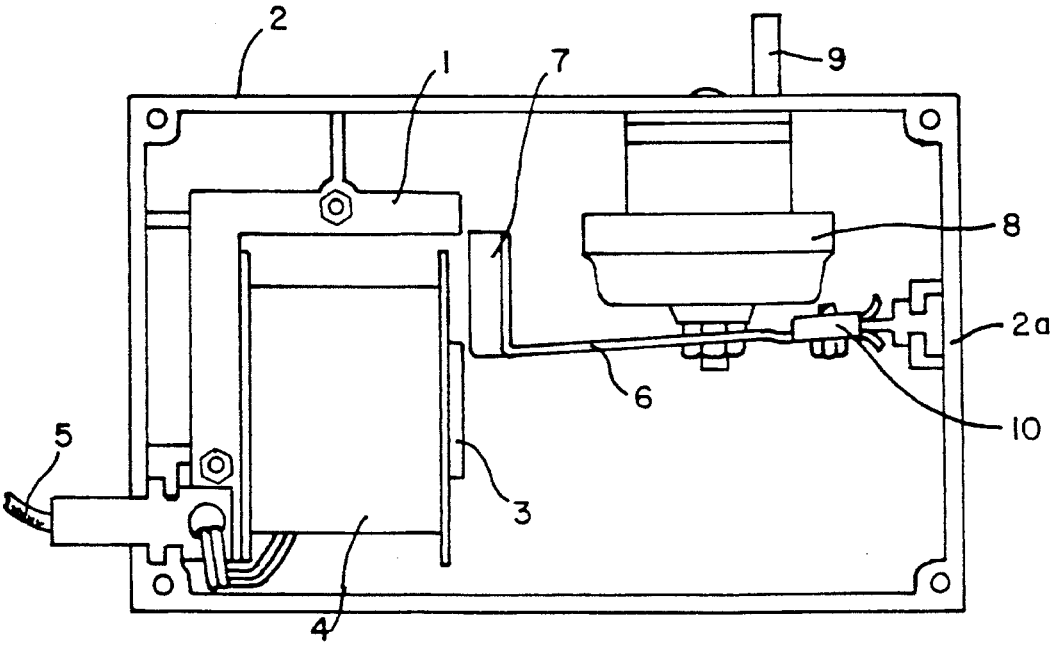
FIG. 8 PRIOR ART
FIG. 8 is a top plan view showing, by way of example, a conventional air pump with its interior exposed.

As shown in FIG. 5, the external end surface of the lug member 27 (corresponding to the bottom surface of the cylinder) is provided with an indication showing the direction in which the lug member 27 is turned and the degree of air control (HIGH or LOW). As shown in FIGS. 2, 6 and 7, a click section 29 is provided at the position between the lug member 27 and the externally threaded member 25, in other words, at the end portion of the coupling section of the lug member 27 relative to the housing 12. The click section 29 comprises radial grooves 30 formed on the end surface of the annular coupling section of the lug member 27 relative to the housing 12, and an engagement piece 31 adapted to be fitted into the grooves 30. The grooves 30 are circumferentially radially formed over the end surface of the coupling section at predetermined angular distances. The engagement piece 31, on the other hand, is secured to the bottom plate 12*c* of the housing 12 and fitted into the grooves 30 to restrict the rotational action of the lug member 27, thereby imparting a moderate resistance to the operator at certain angular intervals with respect to the rotation of the lug member 27. Thus, the externally threaded member 25, the lug member 27 and the click section 29 will constitute the screw feed mechanism for advancing and retreating the yoke 11 with respect to the magnet.

A yoke presser member 32 abuts against the top surface of the yoke 11. The yoke pressure member 32 comprises a presser piece 33 which takes the form of trapezoidal sides flaring downward when viewed sideways, and a pair of vertical plates 35 upwardly extending from the top surface of the presser piece 33 and having on their respective both side sawtooth portions 34. The presser piece 33 is made of a bent plate material having a generally spring structure. Thus, by fitting the sawtooth portions 34 into a holder section 37 provided on the reverse side of a closure 36 of the housing 12, the presser plate 33 is mounted on the housing 12 on its closure side.

It is to be appreciated that the upper half of the housing 12 is exposed to show the interior of the air pump in FIG. 1 and that the upper half of the housing 12 is mounted with the closure 36, as partly shown in FIG. 4, to complete the air pump. Upon the mounting of the closure 36, the presser piece 33 of the yoke pressure member 32 is abutted against the top surface of the yoke 11 and resiliently deforms, thereby securely holding the yoke 11 through the spring action and preventing a loose and unsteady movement which may be caused at the time when the yoke 11 is advanced and retreated by the screw feed mechanism.

Description will now be given of the action of an air controller having such a construction. When the air pump is first actuated, the magnet 17 reciprocates together with the arm 16 by the driving action of the electromagnetic driving mechanism, whereupon the diaphragm 18 performs air intake and discharge action. The air discharged from the diaphragm 18 is temporarily reserved in an air reserving chamber not shown formed in the interior of the frame member 19, and then discharged through a nozzle section 38 to the exterior of the air pump. The thus discharged air is led, through a hose not shown connected to the the nozzle 38, into the tank for generating bubbles.

Then, if the lug member 27 is turned to the right, the thread function exerted between the lug member 27 and the externally threaded member 25 will allow the yoke 11 to advance to strengthen the electromagnetic action, with the result that the air intake and discharge action of the diaphragm 18 can be encouraged to increase the air delivery rate of the air pump. On the contrary., if the lug member 27 is turned left, the thread function exerted between the lug member 27 and the externally threaded member 25 will allow the yoke to retreat to weaken the electromagnetic action, with the result that the air intake and discharge action of the air pump can be saved to reduce the air delivery rate of the air pump. In this manner, a simple operation of the lug member 27 would allow the air delivery rate of the air pump to be optionally increased or decreased, thereby making it possible to vary the state of bubbling within the tank.

As described hereinabove, according to the air pump of the present invention, comprising the electromagnetic driving mechanism, the magnet carried on the tip of the arm, and the diaphragm connected to the intermediate portion of the arm, the magnet being reciprocated by the electromagnetic action exerted between the electromagnetic driving mechanism and the magnet, the intake and discharge action being carried out by the expansion and contraction of the diaphragm, the electromagnetic driving mechanism is mounted on the housing in such a manner that it is capable of advancing and retreating with respect to the magnet, whereby the advancement and retreat of the electromagnetic driving mechanism will allow the change of the distance between the core and the magnet and hence the change of the reciprocating rate of the magnet, thus making it possible to regulate the amount of the air intake and discharge and to vary the state of bubbling within the tank.

While the prevent invention has been described in connection with the preferred embodiment, it is not intended to limit the scope of the invention to the particular form set forth, but on the contrary, it is intended to cover such alternatives, modifications and equivalents as may be included within the spirit and scope of the invention as defined by the appended claims.

What is claimed is:

1. A selectively variable air pumping rate controller for an air pump comprising:

an electromagnetic drive mechanism having an electromagnetic circuit and an electromagnetic coil thereof having a core coaxial therein;

a deflectable mounted arm biased to a rest position and extending toward said coil;

a magnet mounted on said arm for cyclically deflecting said arm to a position confronting said coil core under control of electromagnetic action of the electromagnetic coil when energized thereby cyclically deflecting and reciprocally driving said arm between said rest position and said position confronting said core;

means for connecting said arm to a diaphragm air pump for reciprocally driving the air pump and pumping air under control of said electromagnetic drive mechanism;

a screw feed device for selectively varying the air delivery rate of the air pump by varying the electromagnetic action of the electromagnetic coil on said magnet mounted on said arm comprising a threaded screw for variably alternatively advancing the electromagnetic coil and core therein in an axial direction of the core toward said arm for increasing the air delivery rate of the air pump and retracting the electromagnetic coil and core therein in an opposite direction away from the arm to decrease the air delivery rate of the pump.

2. A selectively variable air pumping rate controller for an air pump according to claim 1, in which said arm is free at one end and said magnet is mounted adjacent said free end for deflecting said arm and reciprocating said free end of said arm.

3. A selectively variable air pumping rate controller for an air pump according to claim 1, in which said arm has a free end disposed toward said core, and said arm is made of a spring material.

4. A selectively variable air pumping rate controller for an air pump according to claim 1, including a diaphragm on said air pump reciprocably actuated by said arm for pumping air under pressure, and means for discharging the air under pressure.

5. A selectively variable air pumping rate controller for an air pump according to claim 4, in which said means for discharging the air under pressure comprises a conduit connectable to an aquarium containing water to develop variable rates of bubbles therein.

6. A selectively variable air pumping rate controller for an air pump according to claim 1, including a housing having said air pump, said arm, said electromagnetic drive mechanism, and said screw feed device therein, said threaded screw extending out of said housing for variably positioning said electromagnetic coil and core internally of said housing for variably varying the air delivery rate of the air pump.

7. A selectively variable air pumping rate controller for an air pump according to claim 6, including means for allowing axial travel of said threaded screw at selected axial intervals.

* * * * *